US005324900A

United States Patent [19]

Gonser et al.

[11] Patent Number: 5,324,900

[45] Date of Patent: Jun. 28, 1994

[54] FOOTSWITCH FOR DENTAL AND MEDICAL USES

[75] Inventors: Donald I. Gonser, Lancaster; Michael J. Butchko, Mechanicsburg, both of Pa.

[73] Assignee: Den-Tal-Ez, Inc., Audobon, Pa.

[21] Appl. No.: 989,706

[22] Filed: Dec. 14, 1992

Related U.S. Application Data

[62] Division of Ser. No. 851,095, Mar. 13, 1992, Pat. No. 5,214,360.

[51] Int. Cl.[5] ..... H01H 3/14; H01H 9/04

[52] U.S. Cl. ..... 200/86.5; 200/302.1

[58] Field of Search ..... 200/86.5, 302.1, 302.2, 200/302.3

[56] References Cited

U.S. PATENT DOCUMENTS

| | | | |
|---|---|---|---|
| 2,133,160 | 10/1938 | Barlow | 200/43.13 |
| 2,814,703 | 11/1957 | Martin | 200/302.2 |
| 3,083,278 | 3/1963 | Mukai | 200/86.5 |
| 4,293,764 | 10/1981 | Amrhein | 200/302.2 |
| 4,319,099 | 3/1982 | Asher | 200/5 A |
| 4,771,139 | 9/1988 | DeSmet | 200/5 A |
| 4,918,270 | 4/1990 | Orrico | 200/302.2 |
| 4,977,300 | 12/1990 | Schroeder | 200/293 |

*Primary Examiner*—J. R. Scott

*Attorney, Agent, or Firm*—Howson and Howson

[57] ABSTRACT

A sealed omnidirectional operable footswitch particularly suited for use in connection with dental and medical position programmable adjustable chairs.

5 Claims, 3 Drawing Sheets

FOOTSWITCH FOR DENTAL AND MEDICAL USES

CROSS-REFERENCE TO RELATED APPLICATION(S)

The present invention is a division of copending application Ser. No. 07/851,095, filed on Mar. 13, 1992, now U.S. Pat. No. 5,214,360.

FIELD OF THE INVENTION

The present invention relates to powered adjustable chairs, and more particularly, the present invention relates to position programmable powered chairs particularly suited for use in medical and dental applications.

BACKGROUND OF THE INVENTION

In the modern dental operatory, a powered chair is provided to enable a dentist, or dental assistant, to adjust the chair components into selected positions simply by pressing control buttons. Thus, the chair seat may be raised or lowered to provide an entry/exit position for ease of patient ingress and egress, and the chairback may be pivoted relative to the seat, depending upon the particular preference of the health professional and the procedure to be performed. Early in their development, such chairs were customarily preprogrammed at the factory to assume particular positions, but now some have the capability of being adjusted by the health professional to suit his/her particular preferences.

For instance, U.S. Pat. No. 4,168,099 issued to Jacobs discloses an examination chair particularly suited for use in gynecological examinations. The chair is preprogrammed at the factory to assume automatically a selected one of several standard gynecological examination positions. A footswitch is utilized to actuate the chair control mechanism to effect automatic operation. The chair does not appear to be capable of being programmed in situ by the health professional.

Early attempts to enable chairs to be adjusted in situ included control systems which operated by timing the operation of motors to bring the various chair components into preselected positions. A stated drawback of this approach was the imprecision with which the chair components could be positioned due to the lack of a positive indication of chair position relative to a programmed set point.

The aforementioned drawbacks were stated to be overcome by the control mechanism disclosed in U.S. Pat. No. 4,128,797 to Murata. In Murata, the chairback is provided with a series of control switches, including some manual positioning switches for operating the chair manually, a set switch, and an automatic positioning switch. Sensors are provided for detecting the positions of the various chair components to provide a memorized position when the set switch is actuated at a visually-observed chair position, so that when the automatic switch is actuated, the chair will move precisely to the pre-set position. A drawback of the chair disclosed in Murata is the use of electric motors and higher than desirable voltages in association with the chair sensors to provide the desired control inputs and motions.

In at least one currently commercially available programmable adjustable chair, a recessed set button is provided in a control console at the base of the chair to program a chair position. As a result, when the chair has been adjusted to a preselected position, using manual positioning switches, the health professional must kneel down on the floor and press the button with an implement to input the pre-selected chair position. While this chair may function satisfactorily for its intended purpose, this method of automatic programming is inconvenient to the health professional and, therefore, less than completely desirable. Furthermore, while a footswitch is provided for use in moving the chair components into various positions, the footswitch utilizes a rocker actuator which is not sealed against liquids that might be spilled onto the floor of the operatory adjacent to the footswitch and such a switch does not afford omnidirectional actuation.

OBJECTS OF THE INVENTION

An object of the present invention is to provide an improved footswitch that is omnidirectionally operable and impervious to liquids, yet which is durable, easy to use, straightforward to manufacture, and reliable in operation.

SUMMARY OF THE INVENTION

The footswitch includes a cover molded of flexible plastic material and mounting a series of button actuators on its topside. Each button actuator includes a live hinge formed integral with the cover so that when a button actuator is depressed, either axially or obliquely, it moves inwardly to engage a switch mounted inside the cover. To protect the switches against excessive button actuator deflection, they are carried on a plate resiliently mounted underneath the cover.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
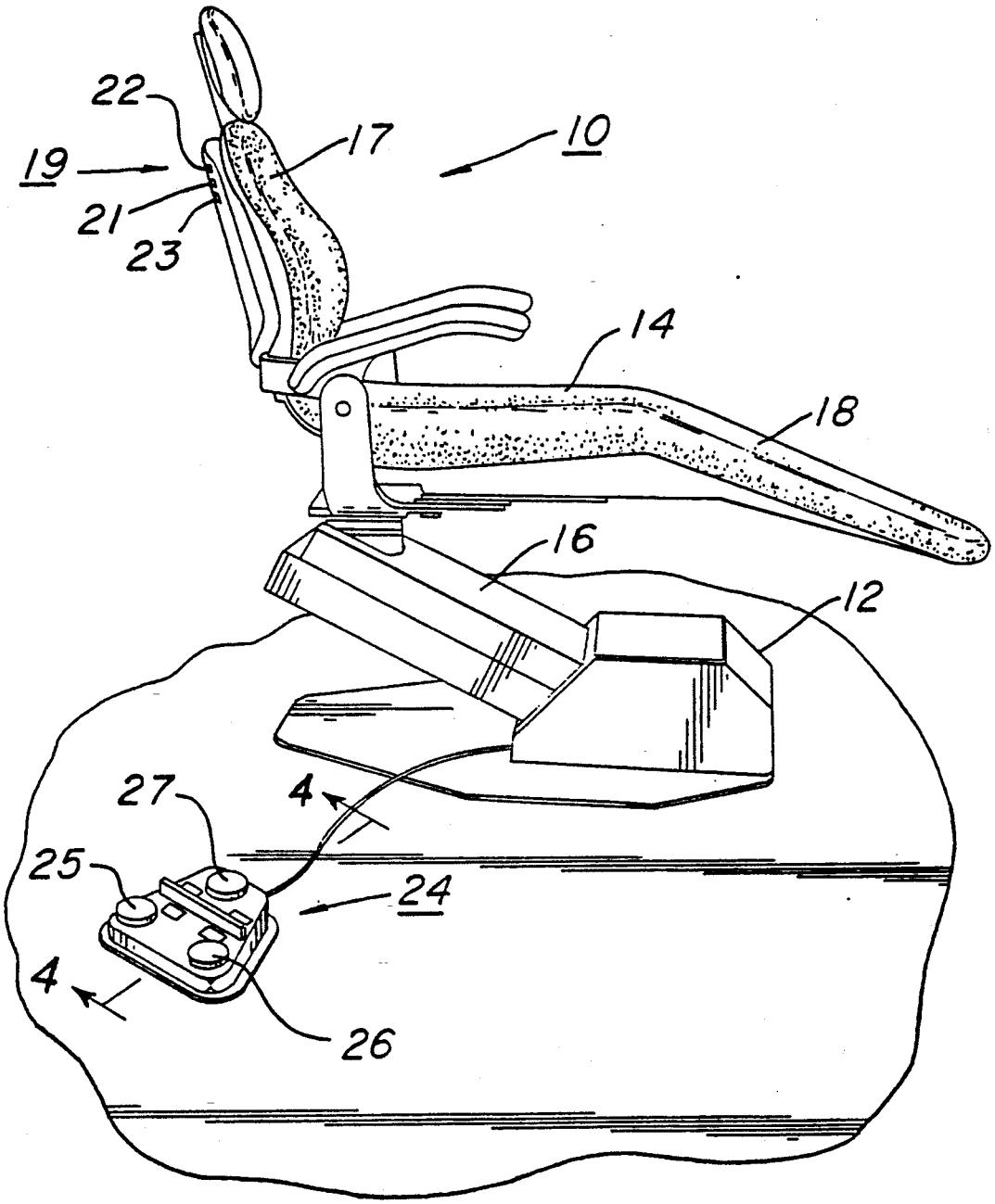
FIG. 1 is a side-elevational view of a programmable adjustable chair embodying the present invention.

Referring now to the drawings, FIG. 1 illustrates a chair 10 of the type which finds particular utility in connection with performing medical and dental procedures on patients. The chair 10 comprises a base 12, a seat 14 supported by the base and mounted for vertical movement between upper and lower limit positions by means of an ar 16 pivotally mounted to the base 12. The arm 16 is driven by an hydraulic actuator controlled by a solenoid valve (not shown). A backrest 17 is mounted to the seat 14 for pivotal movement between upright and recline limit positions and is pivoted by means of a separate hydraulic actuator controlled by a solenoid valve (not shown). A leg rest 18 is pivotally connected to the seat 14 and moves in conjunction with movement of the backrest 17. An hydraulic pump (not shown) is provided in the base 12 for driving the hydraulic actuators in response to actuation of the hydraulic control valves. A programmable electronic control module (not shown) is mounted in the chair base 12 for controlling movement of the various chair components as will be described.

For the purpose of operating the electronic control module, a series 19 of three momentary-contact push button switches 21, 22, 23 are provided along each side of the chairback. The middle switch 21 controls up and down movement of the seat base 14; the upper switch 22 controls pivotal movement of the backrest 17 and, therefore, the leg rest 18; and the lower switch 23 controls automatic movement of the seat base 14 to a programmed position. A footswitch 24 having corresponding button actuators 25, 26, and 27 is also provided to effect the same chair movements with the use of foot pressure rather than finger pressure.

Figure 2:
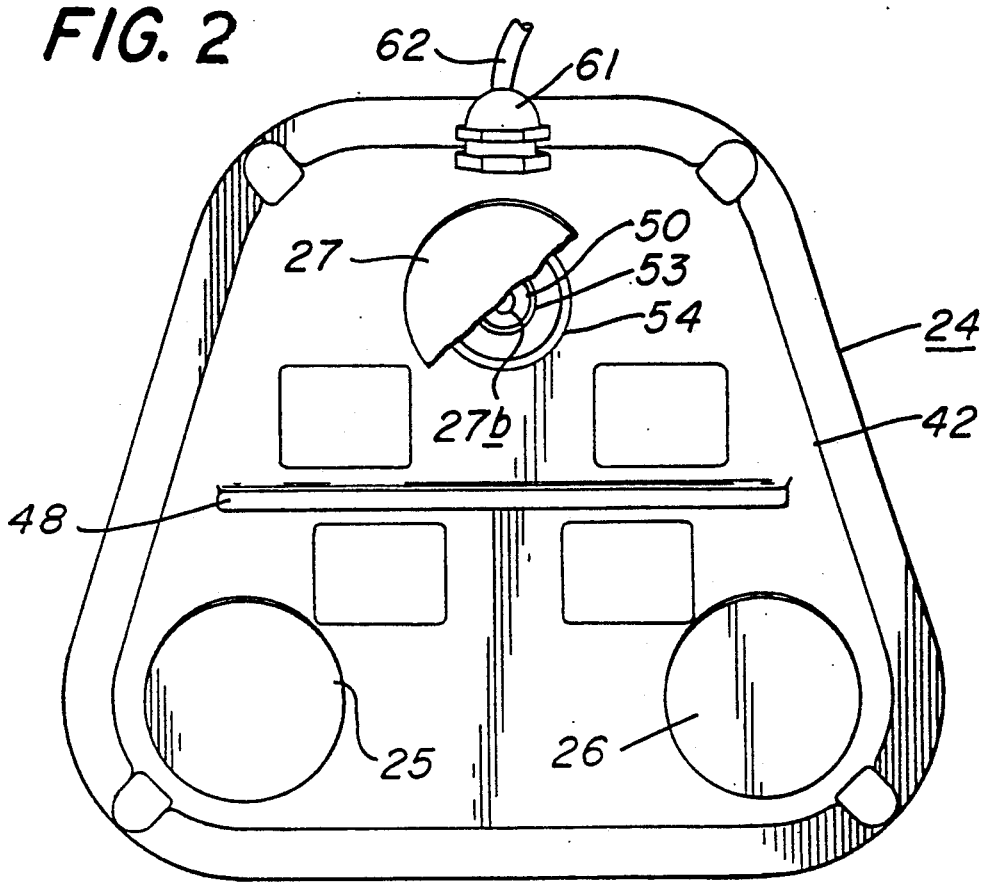
FIG. 2 is a plan view of the footswitch illustrated in FIG. 1.
Figure 3:
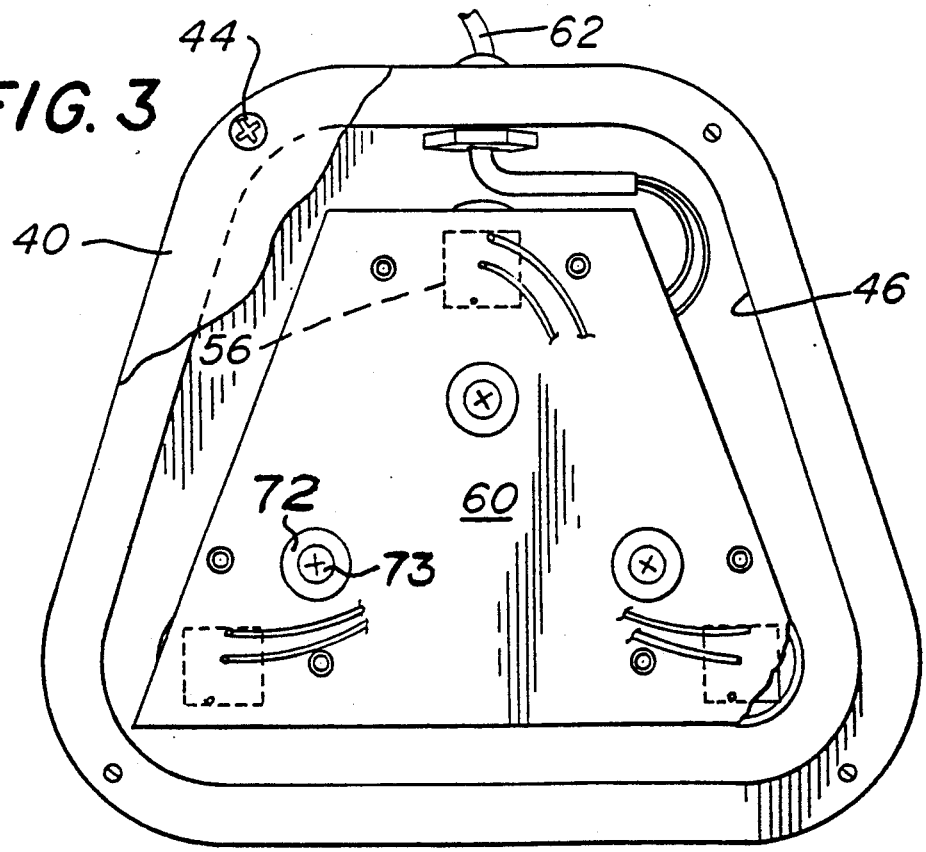
FIG. 3 is an inverted plan view of the footswitch with portions broken away to expose interior details of construction.

The present invention provides the improved footswitch 24 which is particularly suited for use in combination with the chair 10 described above. As best seen in FIGS. 2 and 3, the footswitch 24 comprises a base plate 40 adapted to lay flat on a floor and a molded plastic cover 42 overlying the base plate 40 and fastened thereto by screws, such as the screw 44, to form a closed watertight chamber, or housing 46. In plan view, the footswitch has a generally trapezoidal configuration, and in side elevation is somewhat wedge-shaped. See FIG. 4. The topside of the cover 42 mounts a plurality of circular buttons such as the buttons 25, 26, and 27 described, supra. Preferably, the automatic position button 27 is located at the apex of the cover 42 and is separated from the seat and back buttons 25 and 26, respectively by means of a raised elongate rib 48 extending upwardly from the top surface of the cover 42 to an elevation slightly higher than the top surfaces of the buttons 25–27. The rib 48 is engaged by the ball of the foot of the dentist or his/her assistant to prevent simultaneous engagement of all the buttons. See FIG. 4.

Figure 4:
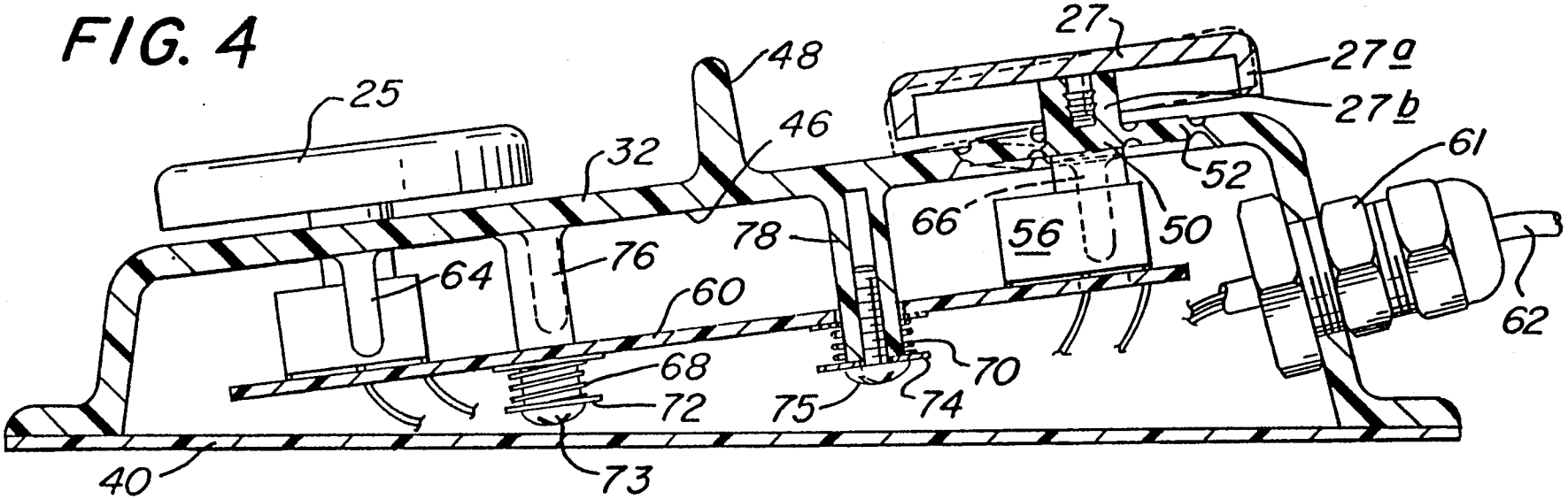
FIG. 4 is an enlarged sectional view taken on line 4—4 of FIG. 1.
Figure 5:
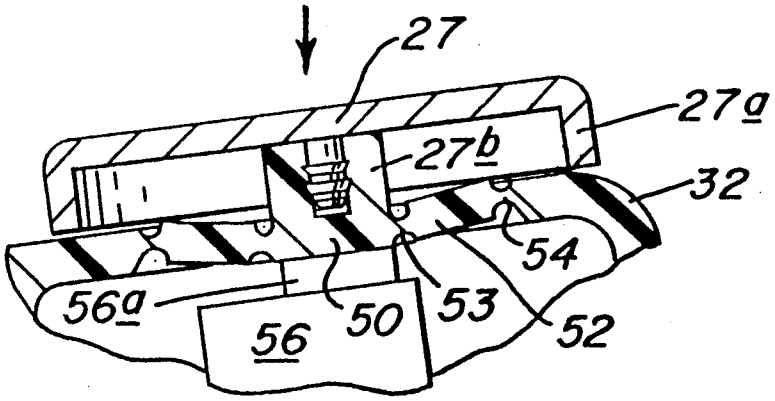
FIG. 5 is a greatly enlarged fragmentary sectional view of a portion of the footswitch in an active position.

Referring now to FIG. 4, each of the buttons, such as the button 27, includes a downturned peripheral flange **27*a* which is spaced from the top surface of the cover by means of a stem 27*b*. The stem projects upwardly from a central region 50 of an annular live hinge 52 formed integral with the cover by two circular rings 53 and 54 of reduced thickness best illustrated in FIGS. 2 and 5. This provides sufficient flexibility to enable the stem 27*b* to be displaced downwardly relative to the plane of the cover 42 when the button 27 is displaced normal to the plane of the cover as illustrated in FIG. 5, and also to move downwardly in response to a tilting action of the button 27 when engaged off-center from the stem 27*b* as illustrated in phantom lines in FIG. 4. Compare FIGS. 4 and 5. The cover 42 is preferably fabricated of polypropylene which has sufficient memory to restore the button to the position illustrated in solid lines in FIG. 4** after foot pressure is removed.

A series of three momentary contact microswitchs are mounted in the chamber 46 below the button stems and live hinge regions. Each switch, such as the switch 56, has an operator **56*a* with a normal path of actuation movement that is aligned with the button stem motion indicated by the arrow in FIG. 5. The switch operator 56*a* has an upper surface located in close proximity with the undersurface of the cover 42 so that relatively small deflection of the cover 42 in the region 50 centrally of live hinge can depress the operator to close the switch 56**.

In order to prevent the switch 56 from being damaged in the event of application of excessive foot pressure, and hence excessive downward displacement of the central region 50 of the live hinge 52, resilient means is provided to mount the switches in the housing. To this end, as best seen in FIG. 4, the switches are fastened on the topside of a trapezoidal mounting panel 60 which is electrically connected via a coupling 61 to an electrical cable 62 releasably connected at its free end to the control console 20 in the base 12 of the chair 10. The mounting panel 60 is held in position in the chamber 46 by means of one, or more, spacers 64, 66, depending from the inside of the cover 42 to engage the upper surface of the mounting panel 60. The mounting panel 60 is maintained in engagement with the spacers 64, 66, by means of helical compression springs 68, 70 which engage the underside of the mounting panel 60 and are compressed between it and washers 72, 74 fastened by screws 73 and 75 to the terminal ends of posts 76, 78 which depend from the underside of the cover 42 through holes in the mounting plate 60. While this form of resilient mounting is preferred, other arrangements may be utilized, such as compressible pads between the mounting plate 60 and the base plate 40, extension springs connecting the mounting plate 40 to the cover 42, and the like.

The above-described switch construction provides a number of advantages. First of all, the switches contained within the chamber are completely sealed against liquid contact. Thus, if desired, the entire footswitch unit can be cleaned by a liquid disinfectant. The button actuators cooperate with their respective live hinges to enable the switches to be actuated by foot pressure applied omnidirectionally, and without the necessity of pushing the button straight downwardly against the cover. The raised rib on the cover supports the ball of the foot to prevent all of the actuator buttons from being depressed simultaneously, and also facilitates selective operation of the buttons. The footswitch is relatively simple in construction and, therefore, straightforward to manufacture utilizing molded plastic components that can be assembled readily.

While a preferred embodiment of a footswitch has been described in detail, various modifications, alterations and changes may be made without departing from the spirit and scope of the present invention as defined in the appending claims.

We claim:

1. A sealed footswitch particularly suited for use in dental and medical operatories, comprising:

a base, a cover mounted to said base and forming therewith a closed housing, at least one switch mounted in said housing, said at least one switch having an operator confronting said cover and movable in a path transverse thereto, means integral with said cover defining an annular flexible hinge above said operator and surrounding said path of movement of said operator, button means projecting upwardly from a central region of said annular flexible hinge along said path of movement of said operator, and resilient means in said housing mounting said at least one switch for movement along said path of movement and toward said base, whereby displacement of said button means under ordinary foot pressure either normal to, or at an angle to, said cover actuates said at least one switch, while displacement under excessive foot pressure displaces said at least one switch against said resilient means to prevent damage to said at least one switch.

2. A sealed footswitch according to claim 1 wherein said button means includes a flange surrounding said annular hinge and normally disposed in spaced parallel relation with said cover.

3. A sealed footswitch according to claim 1 wherein said cover is of one-piece molded plastic construction.

4. A sealed footswitch according to claim 1 wherein said resilient switch mounting means includes a panel disposed in said housing between said cover and said base, at least one spacer depending from said cover for engaging a topside of said panel, and means carried by said cover for biasing said panel toward said cover and against said spacer.

5. A sealed footswitch according to claim 4 wherein said biasing means includes at least one stud depending through a hole in said plate, a helical spring surrounding said stud and engaging a side of the plate opposite said spacer, and means on said stud for compressing said spring against said plate.

* * * * *